US006073534A

United States Patent [19]

Gagnon

[11] Patent Number: 6,073,534

[45] Date of Patent: Jun. 13, 2000

[54] TRANSFER MECHANISM AND METHOD FOR UPLOADING AND DOWNLOADING PROPELLANT CHARGES AND PROJECTILES

[75] Inventor: Joseph A. L. N. Gagnon, Colchester Chittenden, Vt.

[73] Assignee: General Dynamics Armament Systems, Inc., Falls Church, Va.

[21] Appl. No.: 09/144,623

[22] Filed: Aug. 31, 1998

Related U.S. Application Data

[60] Provisional application No. 60/071,465, Jan. 14, 1998.

[51] Int. Cl.[7] ..... F41A 9/00; B65G 1/00

[52] U.S. Cl. ..... 89/45; 198/347.2

[58] Field of Search ..... 89/45, 46, 47, 89/33.01, 33.02, 33.04, 33.2, 33.25, 33.14, 33.16, 33.17; 198/347.1, 347.2, 347.3, 347.4

[56] References Cited

U.S. PATENT DOCUMENTS

| | | | |
|---|---|---|---|
| 1,138,149 | 5/1915 | Reichard . | |
| 1,652,277 | 12/1927 | Herold | 198/803.13 |
| 2,365,028 | 12/1944 | Vesely | 89/35 |
| 2,475,380 | 7/1949 | Elder | 89/35 |
| 2,494,728 | 1/1950 | Stacey et al. | 89/33 |
| 3,178,005 | 4/1965 | Read | 198/24 |
| 3,501,996 | 3/1970 | Lipp et al. | 89/34 |
| 3,575,275 | 4/1971 | Reimers et al. | 198/24 |
| 3,580,131 | 5/1971 | Zimmerman | 89/34 |
| 3,670,863 | 6/1972 | Meier et al. | 89/33.04 |
| 3,696,704 | 10/1972 | Backus et al. | 89/34 |
| 4,125,052 | 11/1978 | Thomas | 89/34 |
| 4,166,408 | 9/1979 | Wetzel et al. | 89/33 |
| 4,557,528 | 12/1985 | Leiber | 303/122.11 |
| 4,563,936 | 1/1986 | Cleary et al. | 89/11 |
| 4,619,181 | 10/1986 | Pehker et al. | 89/34 |
| 4,674,392 | 6/1987 | Beckman | 89/33.04 |
| 4,681,018 | 7/1987 | Beckman | 89/33.04 |
| 4,724,739 | 2/1988 | Heberlein | 72/203 |
| 4,727,790 | 3/1988 | DeHaven et al. | 89/46 |
| 4,765,223 | 8/1988 | Beckman | 89/33.04 |
| 4,772,171 | 9/1988 | Mayer et al. | 414/125 |
| 4,854,216 | 8/1989 | Raymond et al. | 89/33.16 |
| 4,951,547 | 8/1990 | Novet et al. | 89/34 |
| 4,976,185 | 12/1990 | Wixon et al. | 89/35.01 |
| 5,054,367 | 10/1991 | Heidmann et al. | 89/46 |
| 5,097,742 | 3/1992 | Gaye et al. | 89/34 |
| 5,109,751 | 5/1992 | Hagen et al. | 89/33.16 |
| 5,111,731 | 5/1992 | Grabner | 89/46 |
| 5,170,006 | 12/1992 | Maher et al. | 89/46 |
| 5,175,388 | 12/1992 | Maher et al. | 89/35.01 |
| 5,212,338 | 5/1993 | Maher | 89/45 |
| 5,259,290 | 11/1993 | Pehker | 89/35.01 |
| 5,289,754 | 3/1994 | Elspass | 89/46 |
| 5,341,721 | 8/1994 | Kotai et al. | 89/46 |
| 5,563,363 | 10/1996 | Soulaigre et al. | 89/46 |
| 5,614,689 | 3/1997 | Gyre et al. | 89/33.04 |
| 5,837,923 | 11/1998 | Gay et al. | 89/46 |

FOREIGN PATENT DOCUMENTS

| | | |
|---|---|---|
| 0 706 022A | 4/1996 | European Pat. Off. . |
| 3733214 | 4/1989 | Germany . |
| 53-31400 | 3/1978 | Japan . |
| 109491 | 4/1944 | Sweden . |
| 2 129 104A | 5/1984 | United Kingdom . |
| 2 255 621A | 11/1992 | United Kingdom . |

*Primary Examiner*—Charles T. Jordan
*Assistant Examiner*—Jeffrey Howell
*Attorney, Agent, or Firm*—Finnegan, Henderson, Farabow Garrett & Dunner

[57] ABSTRACT

A transfer mechanism that can selectively transfer molded solid propellant charges or projectiles between a transport conveyor and respective storage magazines is described. The transfer mechanism has multiple transfer forks driven from a common drive shaft for engaging the munition(s) and selector gates driven by a gate crankshaft associated with each respective magazine for blocking or permitting the transfer controller to either transfer a projectile or one or more solid propellant charges. Each transfer fork and selector gate can be independently and selectively coupled to, or decoupled from, its respective shaft by respective coupling mechanisms under the command of a controller for coordinated transfer operation. The fork and gate coupling mechanisms, as well as a mechanism coupling the drive shaft to respective driven transfer crankshafts provide "uncoupled" positions with the respective fork or gate element or drive shaft restrained from rotary motion.

21 Claims, 9 Drawing Sheets

TRANSFER MECHANISM AND METHOD FOR UPLOADING AND DOWNLOADING PROPELLANT CHARGES AND PROJECTILES

REFERENCE TO RELATED PATENTS

The invention disclosed herein has particular application to transfer mechanisms for moving large caliber ammunition in and out of storage magazines, such as disclosed in U.S. Pat. No. 5,212,338. The disclosure of the U.S. Pat. No. 5,212,338 patent is incorporated herein by reference. The present application claims priority from U.S. Provisional Application Ser. No. 60/071,465 filed Jan. 14, 1998. The present application also is related to application Ser. No. 09/144,256 of Steward et al., entitled "Bucket Carrier For Molded Solid Propellant Storage Magazine", being filed concurrently herewith and provisional application Ser. No. 60/071,466 filed Jan. 14, 1998.

This invention was made with Government support under contract No. DAAE30-5-C0009 awarded by the United States Army. The Government has certain rights in the invention.

FIELD OF THE INVENTION

The present invention relates to transfer mechanisms for moving storable items between storage spaces and a common outside location, particularly large caliber projectiles and propellant charges between associated, adjacent storage magazines and a common munitions conveyor.

BACKGROUND OF THE INVENTION

Transfer mechanisms designed to automatically move larger caliber ammunition projectiles in and out of storage magazines have been developed for use in various military vehicles. An example of one such transfer mechanism is described in Maher U.S. Pat. No. 5,212,338 dated May 18, 1993. That system is intended to handle only ammunition projectiles, since the bag propellant charges used to propel these projectiles conventionally are loaded manually in such a system. Such manual loading of bag propellant charges is typical of most conventional large caliber weapons systems.

The planned introduction of advanced artillery systems calls for the use of a fully automated ammunition handling capability including the propellant charges. For one of these advanced systems, the propellant charges will actually be molded, combustible containers filled with either ball or stick propellant. An illustration of these new propellant charge modules, referred to as Modular Artillery Charge Systems (MACS), is shown schematically in FIG. 1 and is designated by the numeral 10. The MAC modules each include a combustible annular case body 12 including an inner conical extension 16, a combustible case coating 14, and a combustible case end cap 20 which includes cone extension 22. Individual powder grains 18 are contained within case body 12 and case end cap 20, arrayed around a hollow central core 24 formed by conical extensions 16 and 22 together with tube 26. Inside of core 24 typically are located ignitor-containing bags 28. Covers 30,32 are provided to seal the ignitor bags 28 in core 24.

As one skilled in the art would appreciate, in operating a large caliber gun such as a self-propelled howitzer, a selective number of the individual propellant charges 10 would be used, depending upon the type of projectile, range, etc. required. The MACS transfer mechanism then ideally must be able to selectively transfer into or access from, the storage magazine any single charge, or multiple charges up to all the charges in the carrier. Moreover, space and weight concerns for an automated gun supply system may necessitate a common transfer mechanism to serve a projectile storage magazine on one side of a common conveyor and a MACS module storage magazine on the other side.

However, known transfer mechanisms are configured for handling a single elongated projectile from magazine carriers such as described in U.S. Pat. No. 5,175,388. Whereas each carrier in a projectile magazine stores only one projectile it would be desirable and more space efficient to store multiple MACS modules in a single carrier.

SUMMARY OF THE INVENTION

An objective of the present invention is to provide a mechanism for selectively transferring storable items between a storage location and a location outside the storage location.

Another objective of the present invention is to provide improvements in munitions transfer mechanisms to allow selective transfer of projectiles and one or more propellant charges from respective storage magazines, to an adjacent common conveyor.

To achieve these and other objectives, and as disclosed and broadly claimed herein, the apparatus for selectively transferring storable items between a storage space and a location outside the storage space, includes a rotatable drive shaft positioned proximate the storage space and the outside location, at least one transfer element operatively associated with the drive shaft and having a distal portion configured for engaging an item, and a proximal end. The apparatus further includes a transfer element coupling mechanism for selectively coupling the transfer element proximal end to the drive shaft for dependent rotation therewith. The distal portion is rotatively movable between a position in the storage space and the outside location only when the proximal end is coupled to the drive shaft.

Preferably, the apparatus also includes a gating mechanism for selectively permitting or blocking items from being transferred between the storage space and the outside location. The gating mechanism includes a rotatable gating shaft positioned adjacent the storage space and the outside location, at least one gate element cooperating with the transfer element and operatively associated with the gating shaft, and a gate coupling mechanism coordinated with the transfer element coupling mechanism for selectively coupling the gate element proximal end with the gating shaft for dependent rotation therewith. The gate element distal portion is rotatively movable between transfer permitting and transfer blocking positions only when the gate element proximal end is coupled to the gating shaft.

It is preferred that the apparatus includes a plurality of transfer elements and a like plurality of cooperating gating elements, each independently selectively coupleable to the respective drive shaft or gating shaft for transfer of selective ones of the storable items, and that each respective coupling mechanism also restrains the respective transfer element or gating element from rotary motion when uncoupled from the respective drive shaft.

It is further preferred that each transfer element and gate element proximal end includes a sleeve portion surrounding the respective drive shaft, and that the respective transfer element coupling mechanism or gating mechanism includes a keying member for selectively interconnecting the sleeve portion and the drive shaft for dependent rotation. The sleeve portion preferably can include an aperture with the respective keying member being disposed in the respective shaft to be movable between a coupled position engaging the aperture and an uncoupled position not engaging the aperture, and each respective coupling mechanism preferably can further include a respective actuator assembly disposed for controlling the position of the respective keying member.

It is still further preferred when a pair of storage spaces are positioned adjacent the outside location, that the apparatus includes a pair of separately driven rotatable transfer shafts each positioned adjacent a respective storage space, and a transfer shaft coupling mechanism for selectively coupling the drive shaft to a selective one of the pair of transfer shafts for dependent rotation therewith. The transfer shaft coupling mechanism includes a pair of drive keys carried by the drive shaft for dependent rotation therewith and movable between engaged positions for coupling one or the other transfer shaft to the drive shaft, and disengaged positions where the drive shaft is uncoupled from both the transfer shafts. The transfer shaft coupling mechanism includes an actuator carried by the drive shaft for dependent rotation therewith and operatively connected to both drive keys.

It is yet further preferred that the transfer shaft coupling mechanism further includes a cam fixed relative to rotary motion of the drive shaft, that one of the drive keys includes a cam follower engaging the cam, and that the cam restrain the cam follower and the drive shaft from rotary motion when the drive keys are in the disengaged positions.

Additional features, advantages, and objectives of the invention will be set forth in the description that follows, and, in part, will be apparent from the description, or may be learned from practice of the invention. The objectives and other advantages of the present invention will be realized and attained by the apparatus particularly pointed out in the written description and claims hereof, as well as the appended drawings.

It is to be understood that both the foregoing general description and the following detailed description are exemplary and explanatory and are intended to provide further explanation of the invention as claimed.

The accompanying drawings are intended to provide a further understanding of the invention and are incorporated in and constitute a part of the specification, illustrate preferred embodiment of the invention, and, together with the description, serve to explain the principles of the invention.

BRIEF DESCRIPTION OF THE DRAWINGS

Corresponding reference numerals refer to like parts throughout the several views of the drawings.

DETAILED DESCRIPTION OF PREFERRED EMBODIMENT

Figure 3:
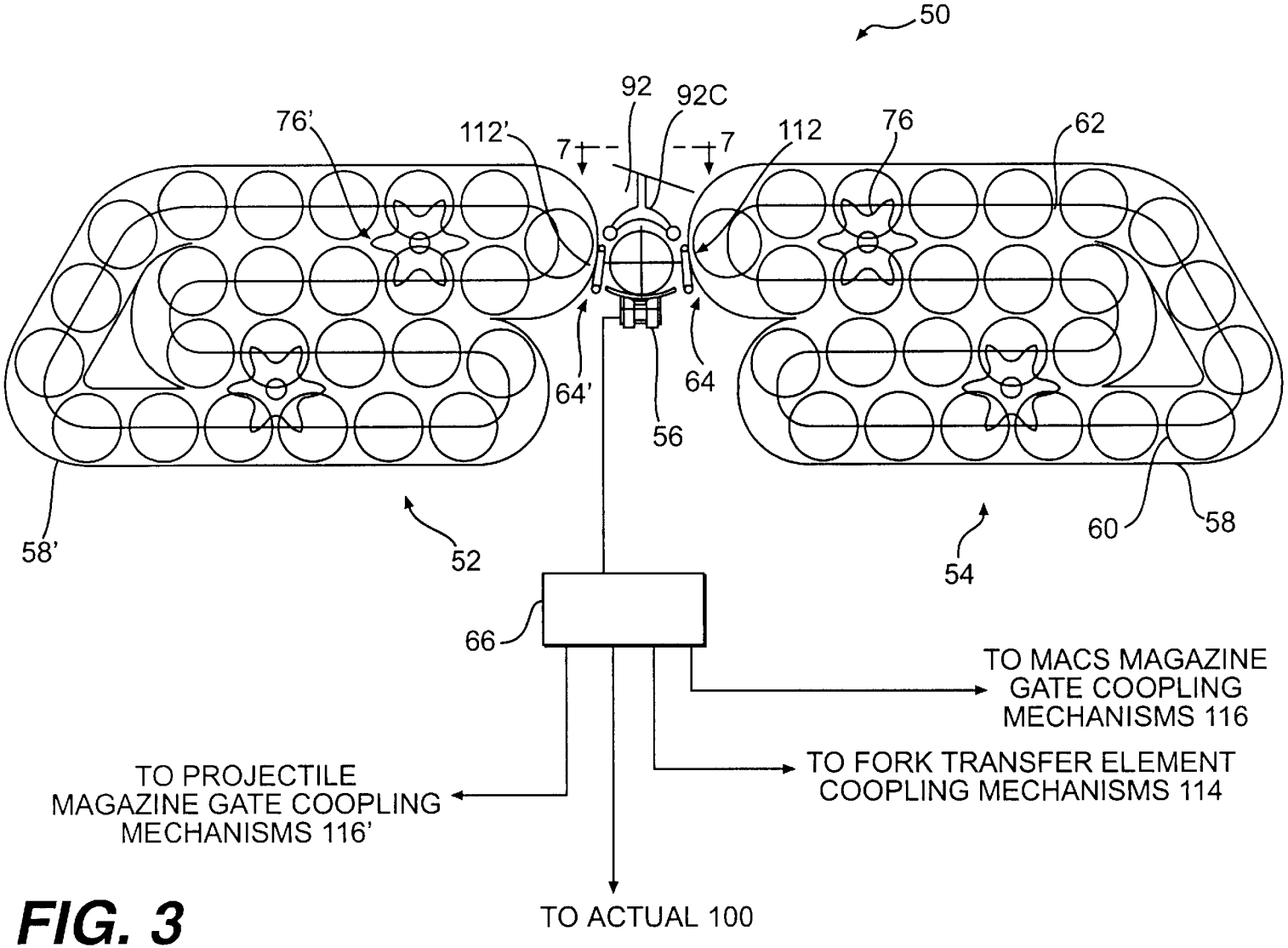
FIG. 3 is a schematic axial end view of components of the transfer apparatus of the present invention in association with a pair of munitions magazines.

With initial reference to FIG. 3, there is shown schematically several components of an apparatus made in accordance with the present invention for handling storable items, the apparatus being designated generally by the numeral 50. In the particular application illustrated in the Figures, apparatus 50 is shown being used to upload and download projectiles and propellant charges from respective magazines 52 and 54 mounted adjacent conveyer 56 in side-by-side relation. Specifically, the transfer apparatus 50 is intended for use in applications having one or more storage spaces and a common location outside the storage spaces between which the storable items can be moved by components of apparatus 50 that will be discussed in more detail henceforth. As embodied herein, the projectile and propellant charge magazines 52 and 54 respectively comprise two such storage spaces and axial conveyor 56 represents the outside location, as would readily be understood by those skilled in the art. The present application thus is similar to the configuration disclosed in U.S. Pat. No. 5,212,338, but being an improvement over the apparatus disclosed in that reference in certain key areas as mentioned previously.

However, the apparatus of the present invention is not intended to be limited by the described embodiment which shows a projectiles and propellant charges comprising the "storable items", nor is the apparatus limited to similar "military-type" applications. Rather, one skilled in the art would immediately perceive the advantage of using the apparatus to be disclosed in more detail hence forth in a wider range of applications. Thus, the apparatus of the present invention is not intended to be circumscribed by the described embodiment, but only by the scope of the appended claims and their equivalents.

As more fully described in the aforementioned U.S. Pat. No. 5,212,338, the disclosure of which is expressly incorporated by reference, magazines 52 and 54 each can preferably include a frame such as frame 58 of magazine 54 for carrying a plurality of dedicated carriers such as carrier 60 moved along an endless serpentine track schematically depicted as 62 in FIG. 3 by drive train 71 (See FIG. 5) to be discussed in more detail later. Magazine frame 58 can be enclosed by a suitable covering except for the portion adjacent axial conveyor 56, namely a "turn around" portion 64 of magazine 54.

Figure 1:
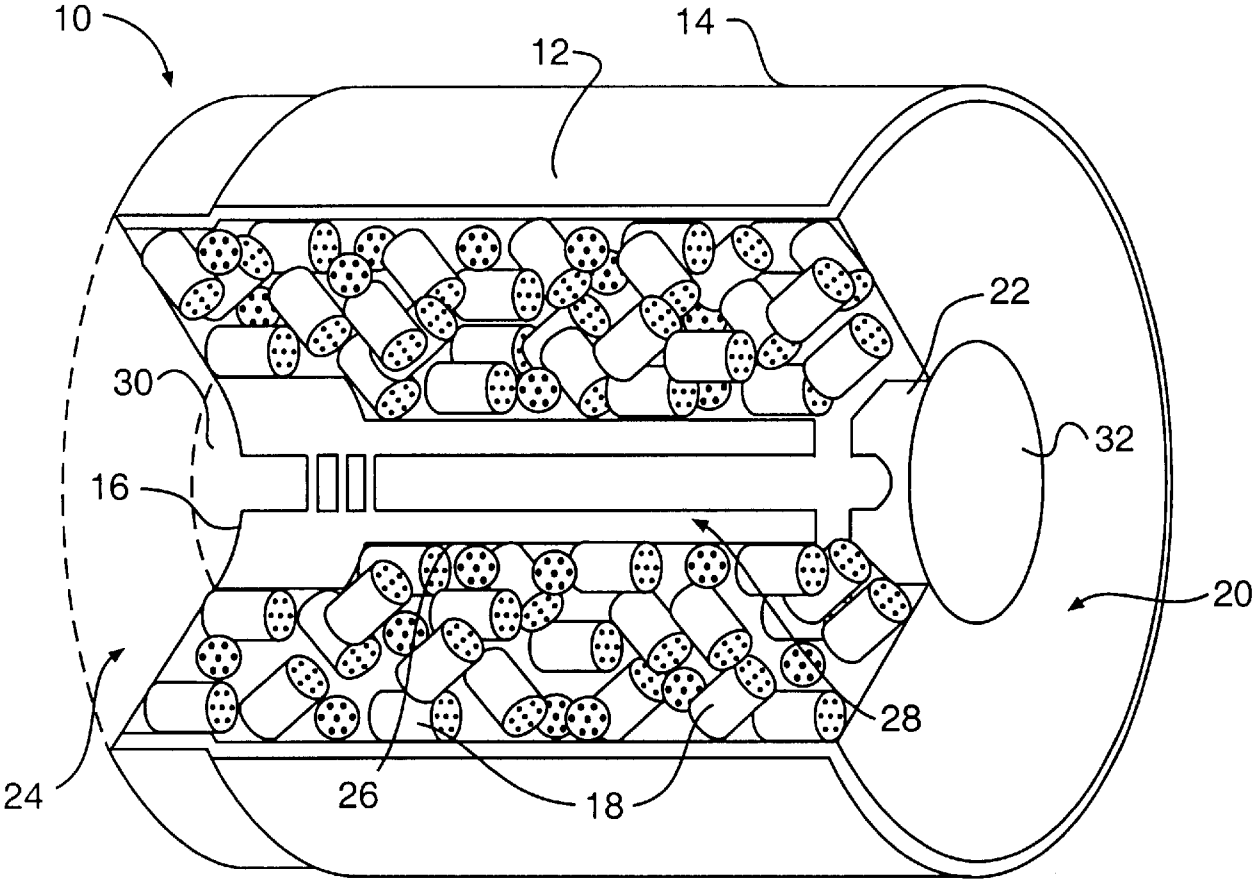
FIG. 1 is a schematic perspective, cut-away view of a storable molded propellant charge module that can be selectively transferred using the present invention.
Figure 2:
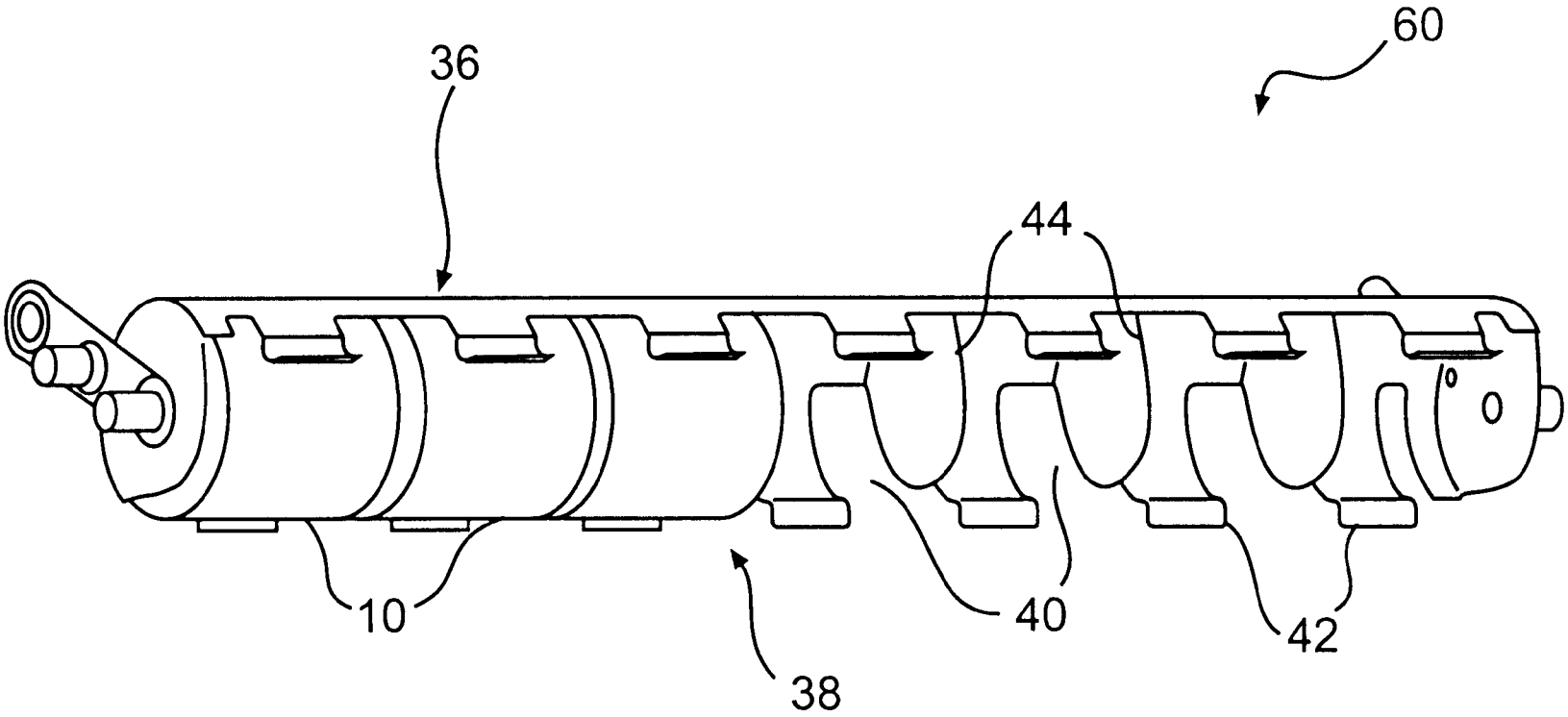
FIG. 2 is a schematic perspective view of a carrier for storing propellant charge modules of the type shown in FIG. 1.

An example of a suitable projectile carrier for use in magazine 52 is detailed in U.S. Pat. No. 5,175,388, the disclosure of which is hereby incorporated by reference, while a carrier suitable for use in magazine 54 for handling modularized propellant charges such as MAC modules is that depicted in FIG. 2 and is described in separate co-pending application "Bucket Carrier for Molded Solid Propellant Storage Magazine", patent docket no. 52-AR-2346, Ser. No. (not yet assigned), filed concurrently herewith, the disclosure of which is hereby incorporated by reference. As seen in FIG. 2, carrier 60 includes a generally cylindrical bucket 36 having an axially extended opening 38 with spaced, circumferential reliefs 40 to define opposing resilient "fingers" 42 for releasably capturing items having a cylindrical shape, such as MACS propellant charges 10. The improved carrier 60 shown in FIG. 2 advantageously includes axial barrier members 44 to compartmentalize the carrier for handling discreet propellant charges such as molded MAC charges 10 depicted in FIG. 1.

Axial conveyor 56 which is under the control of controller 66 which also synchronizes the operation of selectively operable components of transfer apparatus 50, as will be explained henceforth, will stop at the proper time such that the projectile or the propellant modules are properly positioned axially for an "up-load" transfer.

Figure 5:
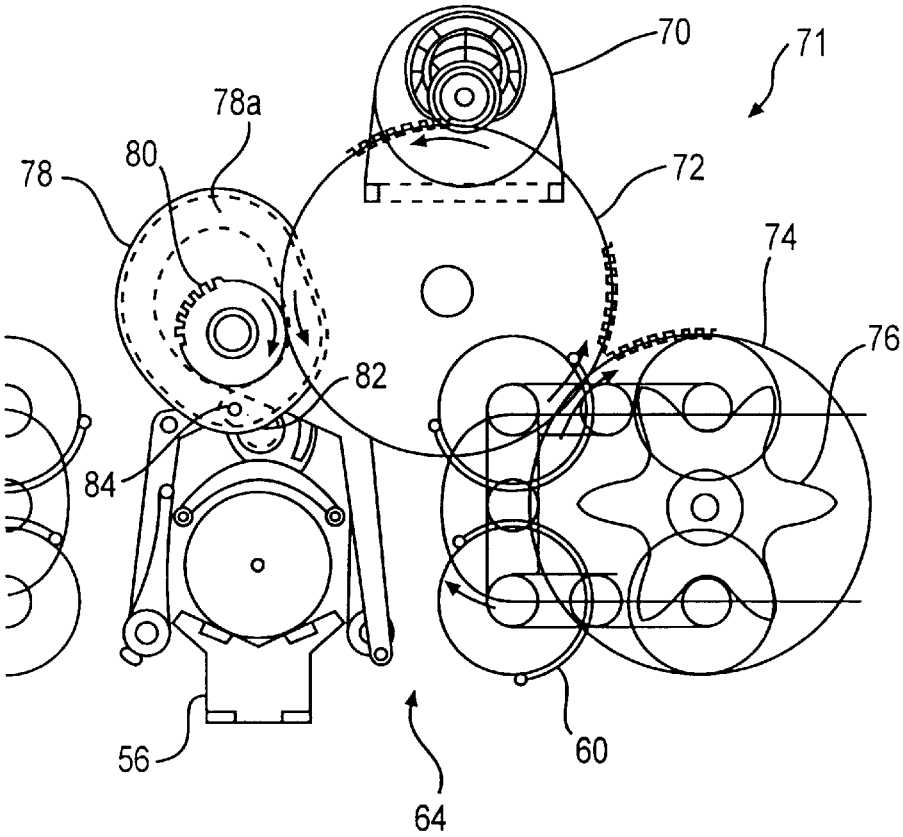
FIG. 5 is a partial schematic axial view of certain components of the transfer apparatus of the embodiment.
Figure 6:
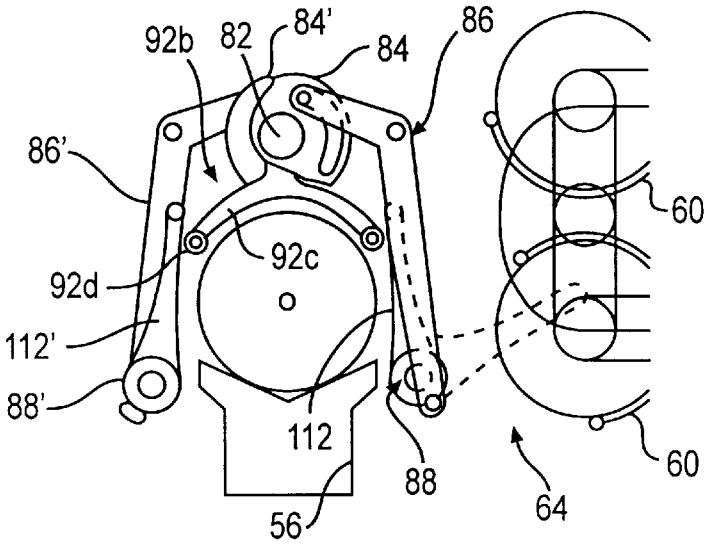
FIG. 6 is another partial schematic axial view of certain components of the transfer apparatus of the embodiment.
Figure 7:
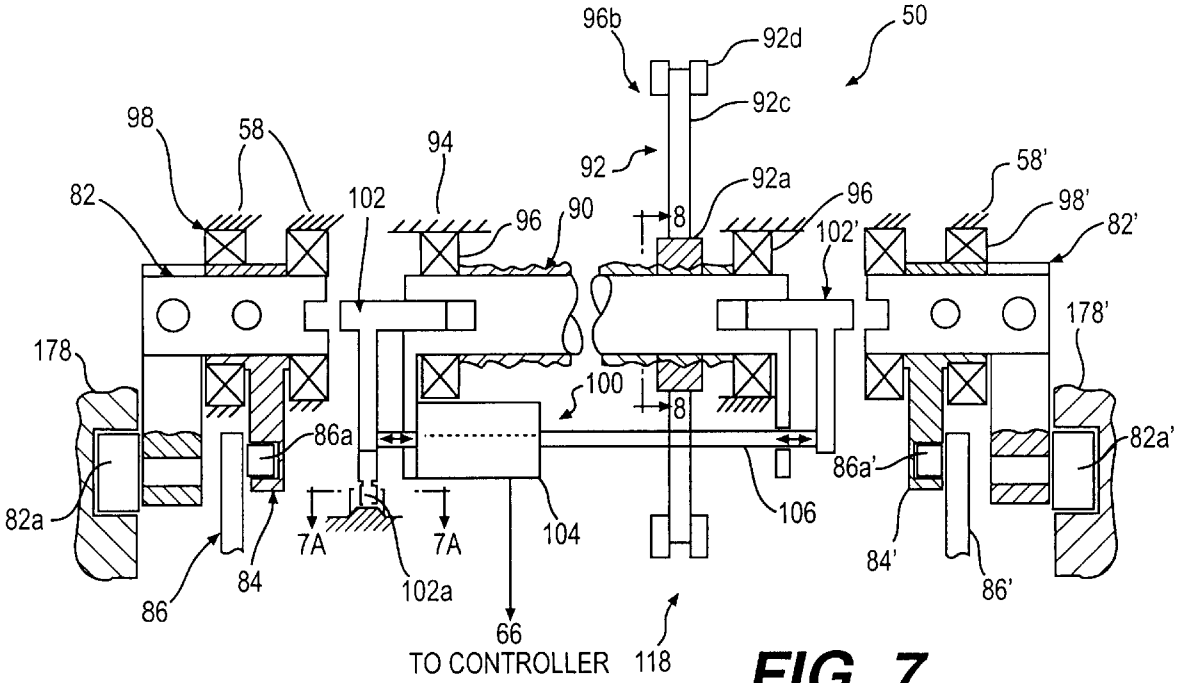
FIG. 7 is a schematic sectional view of certain components of the transfer apparatus of the embodiment in FIG. 3 taken along the lines 7—7 in FIG. 3.

In accordance with a preferred embodiment of the invention, the transfer apparatus has a transfer crankshaft and a gate crankshaft both disposed adjacent the storage location and the outside location. As embodied herein, and as best seen in FIGS. 5, 6, and 7, each magazine 52,54 has a respective drive motor and associated drive train, such as drive motor 70 and drive train 71 for magazine 54, for cycling the carriers past a turn-around location where propellant charge modules or projectiles are to be transferred. As also embodied herein, each magazine also has associated transfer crankshaft and gate crankshaft as is depicted in the FIGS. Specifically, propellant magazine drive motor 70 engages gear 72 which causes movement of carriers 60 in the magazine, via gear 74 and drive sprocket cluster 76, and causes transfer cam 78 to rotate via gear 80. In turn, coupled transfer crankshaft 82 will move in an oscillatory manner as follower 82*a* traces groove 78*a* in transfer cam 78. Projectile magazine 52 has an identical set of components (designated generally by the same numerals but with a prime), but disposed on an axially opposing end of magazine 52 relative to the location on propellant magazine 54 for reasons that will become apparent from the succeeding discussion.

Each transfer crankshaft is mechanically coupled to its respective gate crankshaft as is best seen in FIG. 6 which shows details of the components for magazine 54. Propellant magazine gate cam 84 is fixed to transfer crankshaft 82, and also moves in an oscillatory motion. Follower 86*a* (See FIG. 7) which engages gate cam 84 causes bell crank 86 to move sympathetically angularly back and forth causing an oscillatory motion of gate crankshaft 88. While the gate crankshaft for each magazine mounts respective gate elements (e.g. gate elements 112 for propellant magazine 54), the gate elements do not necessarily always move with the gate crankshaft as they are only conditionally coupled for dependent rotation, as will be described later. Also, the transfer apparatus of the present invention in its broadest scope does not require the transfer crankshaft or the gate crankshaft. However, these components nonetheless provide important advantages to the transfer system as will also be explained henceforth.

In accordance with the present invention, the transfer mechanism includes a drive shaft positioned proximate the storage location and the outside location, and one or more transfer elements associated with the drive shaft. As embodied herein, and as best seen in FIG. 7, drive shaft 90 with fork-like transfer elements 92 mounted thereon in axially spaced relation (only one being shown for clarity) is mounted to frame structure 94 by appropriate bearings 96 to be adjacent turn-around positions 64 and 64' of both magazines. Shown spaced from opposite axial ends of drive shaft 90 are propellant magazine transfer crankshaft 82 and projectile magazine transfer crankshaft 82', which as previously described, move in an oscillatory motion whenever the respective magazine carrier drive train 71 or 71' are being driven by the respective magazine drive motor 70 or 70'. Drive shaft 90 and the two crankshafts are located coaxially for reasons that will become apparent. Propellant magazine transfer crankshaft 82 is mounted for rotation on frame structure 94 by bearings 98, while projectile magazine transfer crankshaft 82' is similarly mounted on projectile structure frame 94 by bearings 98'. In the depicted embodiment, frame structure 94 mounting drive shaft 90 and both magazine transfer crankshaft 82 and 82' is secured to both frames 58 and 58' but can be a stand-alone structure. Alternatively, drive shaft 90 and transfer crankshaft 82 and/or 82' can be incorporated directly into one or both frames 58 and 58'.

Preferably, drive shaft 90 is only conditionally coupled to either transfer crankshaft with a default position being uncoupled. This conditional coupling is accomplished by transfer shaft coupling mechanism designated generally 118 in FIG. 7 and which includes linear actuator 100 which positions a pair of interconnected drive keys 102,102' in one of the three positions. Actuator 100 includes stator 104 that is fixed to the drive shaft and armature 106 which moves the pair of drive keys 102,102'. The default position is the one shown in FIG. 7 where the armature is in a middle position and neither transfer crankshaft is engaged. The other two position are with keys 102,102' biased in the axial direction either to the left (coupling propellant transfer crankshaft 82 to drive shaft 90) or to the right (coupling projectile transfer crankshaft 82' to drive shaft 90 by actuator 100). When coupled to a transfer crankshaft the entire assembly of drive shaft 90, linear actuator stator 104, and armature 106 with interconnected keys 102,102' will rotate in step with the transfer crankshaft.

Figure 7A:
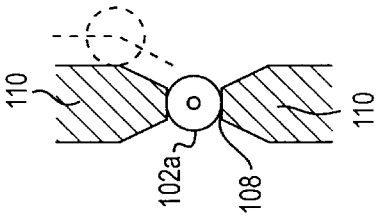
FIG. 7A is a schematic top view of a detail of a component shown in FIG. 7 taken along the lines 7A—7A in FIG. 7.

In accordance with the present invention, the transfer apparatus also preferably includes a cam fixed relative to the rotary motion of the drive shaft for restraining the drive shaft when the drive shaft is uncoupled from both transfer crankshafts. As embodied herein, and as best seen in FIGS. 7 and 7A, in the middle position, when drive shaft 90 is not coupled to either transfer crankshaft 82 or 82', follower 102*a* attached to key 102 is located in central slot 108 of fixed cam 110 as depicted by the solid circle in section 7A—7A of FIG. 7. Follower 102*a* and cam 110 cooperate to provide two functions. The first function is to keep drive shaft 90 indexed in the middle, default position. The second function is to ensure that once one crankshaft has been engaged (e.g., transfer crankshaft 82') and the assembly has started to rotate, the respective key (e.g., key 102') will stay engaged for the full cycle as depicted by the dotted circle and track in FIG. 7A.

Each fork-type transfer element 92 includes proximal end 92*a* and a distal end 92*b*. Distal end 92*b* further includes curved portion 92*c* to conform to the cylindrical shape of the projectile or propellant charge and, preferably, a roller assembly 92*d* to engage the projectile or propellant charge. Proximal end 92*a* of each fork 92 is configured in a sleeve-shape to provide a sliding fit over drive shaft 90. Transfer forks 92, however, do not necessarily rotate or oscillate with drive shaft 90 as they are only conditionally coupled to drive shaft 90, as will now be described.

The principal devices within the transfer apparatus which physically move the projectiles and propellant charges between axial conveyor 56 and the storage magazines 52,54 are forks 92 and selector gates 112, 112' (separate gates being provided for each magazine). Their drive power is derived from the magazine drives themselves, but their operation is controlled by electrical signals commanded by controller 66. The previous discussion illustrates how power is brought to drive shaft 90 and to gate crankshafts 88 and 88' in the depicted embodiment. All that remains to be described is how forks 92 and the selector gates 112,112' are conditionally coupled or "clutched" with the respective shaft. In principal the clutch design is identical for both the forks and the gates. In application the relative size of the components will be different to address the fact that the mechanical forces incident in the operation of forks 90 would generally be greater than the forces involved with selector gates 112,112'.

In accordance with the present invention, the transfer apparatus further includes a transfer element coupling mechanism for selectively coupling the transfer element to the drive shaft for dependent rotation between a storage space position and the outside location when in the coupled condition. Preferably, in accordance with the present invention, the transfer apparatus also includes a gate element coupling mechanism for selectively coupling the gate elements to the respective gate crankshaft for dependent rotation. As embodied herein, and with reference to FIGS. 8 and 9, apparatus 50 includes a transfer element coupling mechanism generally designated 114 for each separate fork transfer element 92 (four being depicted in FIG. 4) and separate gate element coupling mechanisms 116 for each of the four gate elements 112 mounted on propellant magazine gate crankshaft 88. While only four transfer elements are shown according to the present invention in FIG. 4 for clarity, a transfer apparatus using the seven compartment carrier 60 depicted in FIG. 2 would of necessity use at least 7 fork elements 92; however, two or more forks 92 could be used for each compartment. As one skilled in the art would understand, all the gate element coupling mechanisms (not shown) for the projectile magazine gate elements 112' usually will be activated in unison, as only a single elongated projectile would be transferred to/from a carrier in magazine 52. Hence, only a single gate element 112' is depicted in the control schematic of FIG. 4, but each gate element 112' is equipped with a separate coupling mechanism (not shown). However, the number of gate elements 112' and thus coupling mechanisms (not shown) need not be equal to the number of fork transfer elements 92 if a single, elongated projectile is always being transferred to/from magazine 52.

Figure 8A:
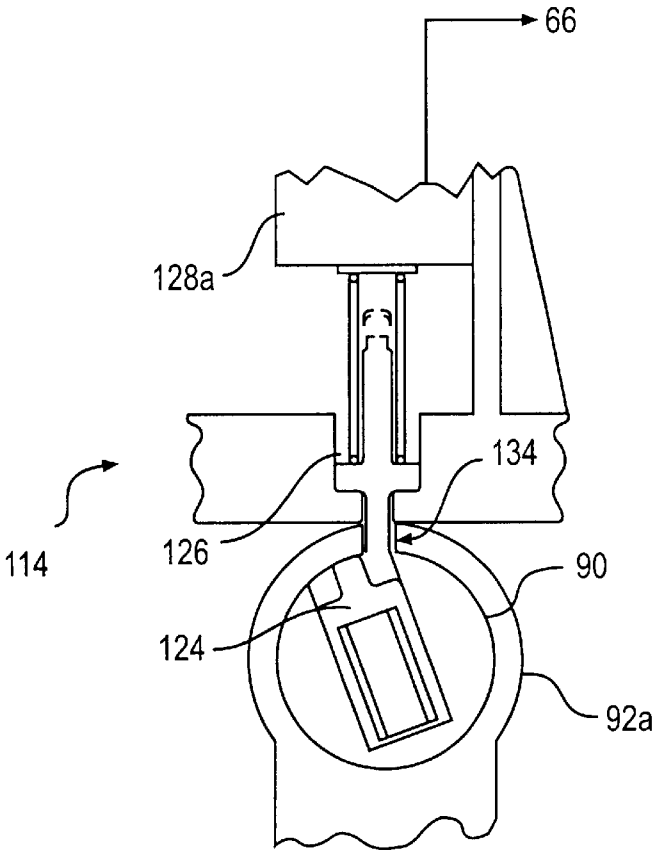
FIGS. 8A–8C are schematic sectional axial views of the components detailed in FIG. 8 during operation.
Figure 8:
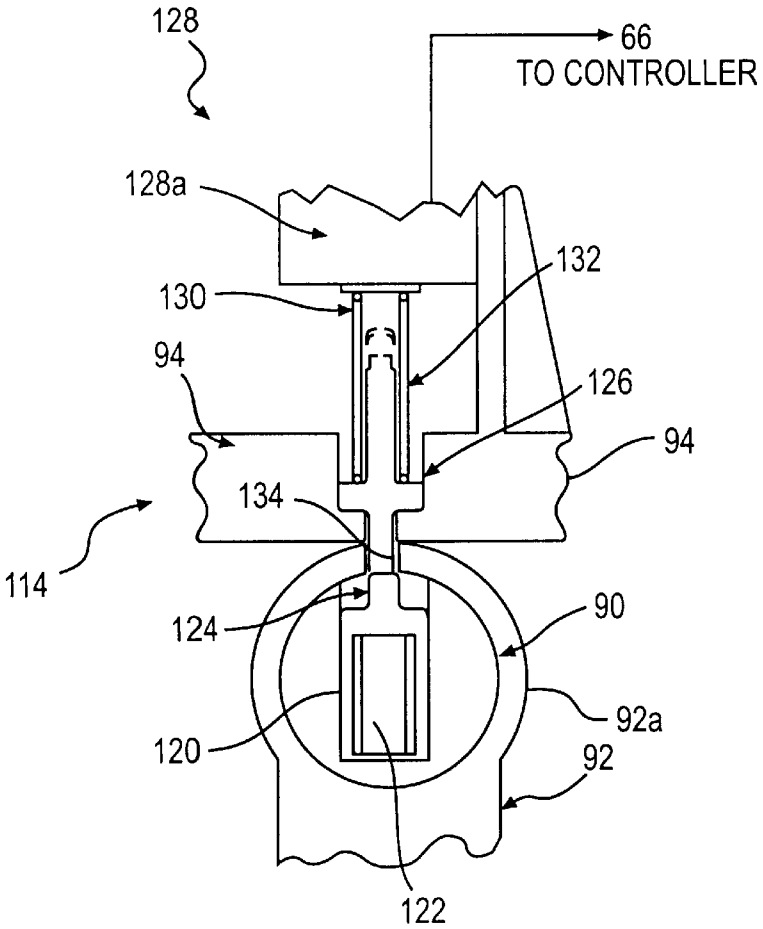
FIG. 8 is a schematic sectional axial detail view of the transfer apparatus taken along the line 8—8 in FIG. 7.

With reference first to FIG. 8, transfer element coupling mechanism 114 includes drive shaft 90 on which forks 92 are held in place (in two dimensions, axial and radial) by a sliding fit, being provided with a transverse blind hole 120 in which engagement spring 122 and key 124 are installed. Located by support structure 94 is decoupling plunger 126 and associated linear actuator 128 which are also part of coupling mechanism 114. Linear actuator 128 is a solenoid type where the armature is free to translate (up and down in FIG. 8) when de-energized and is pulled (up) into the stator 128*a* when energized. Plunger 126 is connected to armature 130 of linear actuator 128 and is spring-loaded in the downward direction by decoupling spring 132. The decoupling and the engagement springs 132 and 122, respectively, are sized such that when linear actuator 128 is de-energized, plunger 126 is forced downward, and if slot-type aperture 134 in sleeve end 92*a* is aligned, plunger 126 will insert into aperture 134 as shown in FIG. 8. With plunger 126 inserted into slot 134, fork 92 is restrained from rotating along with drive shaft 90 as shown in FIG. 8A. In this case, as drive shaft 90 goes through its oscillatory motion, key 124 is kept out of slot 134 by decoupling plunger 126. Key 124 then rides on the inside diameter of fork sleeve portion 92*a*.

Figure 8C:
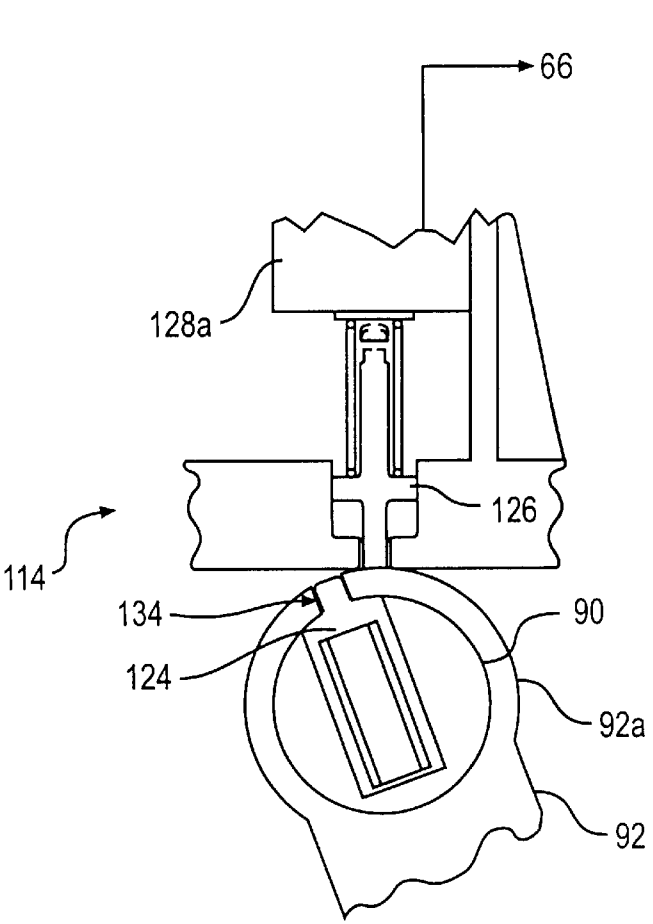
Figure 8B:
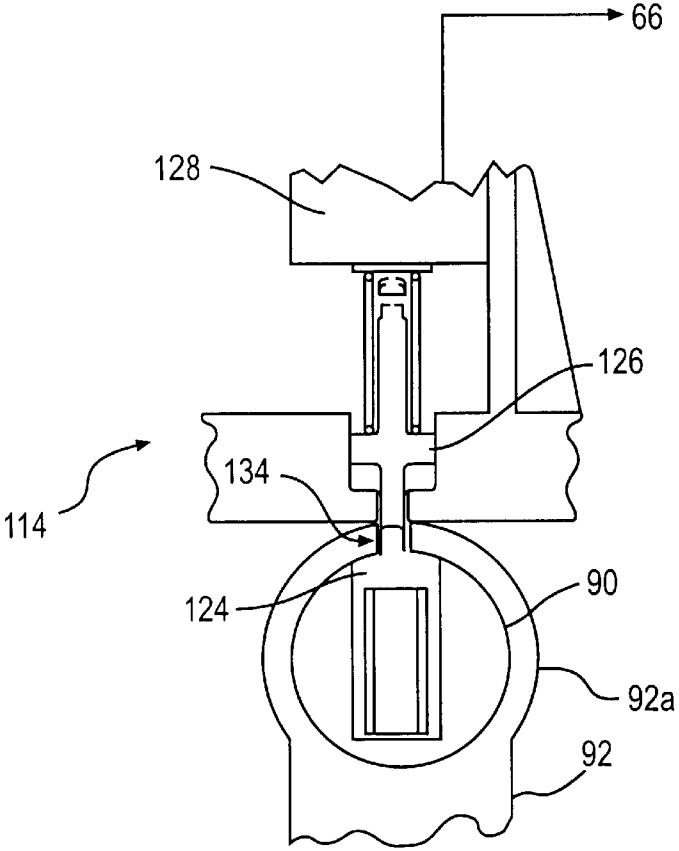

When a transfer is desired requiring a particular fork such as the fork depicted in FIG. 8, a control signal is provide by controller 66 to linear actuator 128 such that armature 130 pulls plunger 126 (up) out of slot-aperture 134 in fork sleeve portion 92*a*. This is timed to occur when the drive shaft is in the position shown in FIG. 8B. Spring-loaded key 124 then moves (upward) into slot 134, coupling fork 92 to drive shaft 90 as depicted in FIG. 8B. On the next cyclic motion of drive shaft 90, fork 92 will rotate along with it as shown in FIG. 8C. Even if linear actuator 128 is de-energized at some time intermediate the endpoints of the oscillatory cycle of drive shaft 90, the oscillatory motion of fork 92 will be completed as plunger 126 rides on the outside diameter of sleeve portion 92*a* until alignment between slot-aperture 134 and key 124 occurs.

Figure 9:
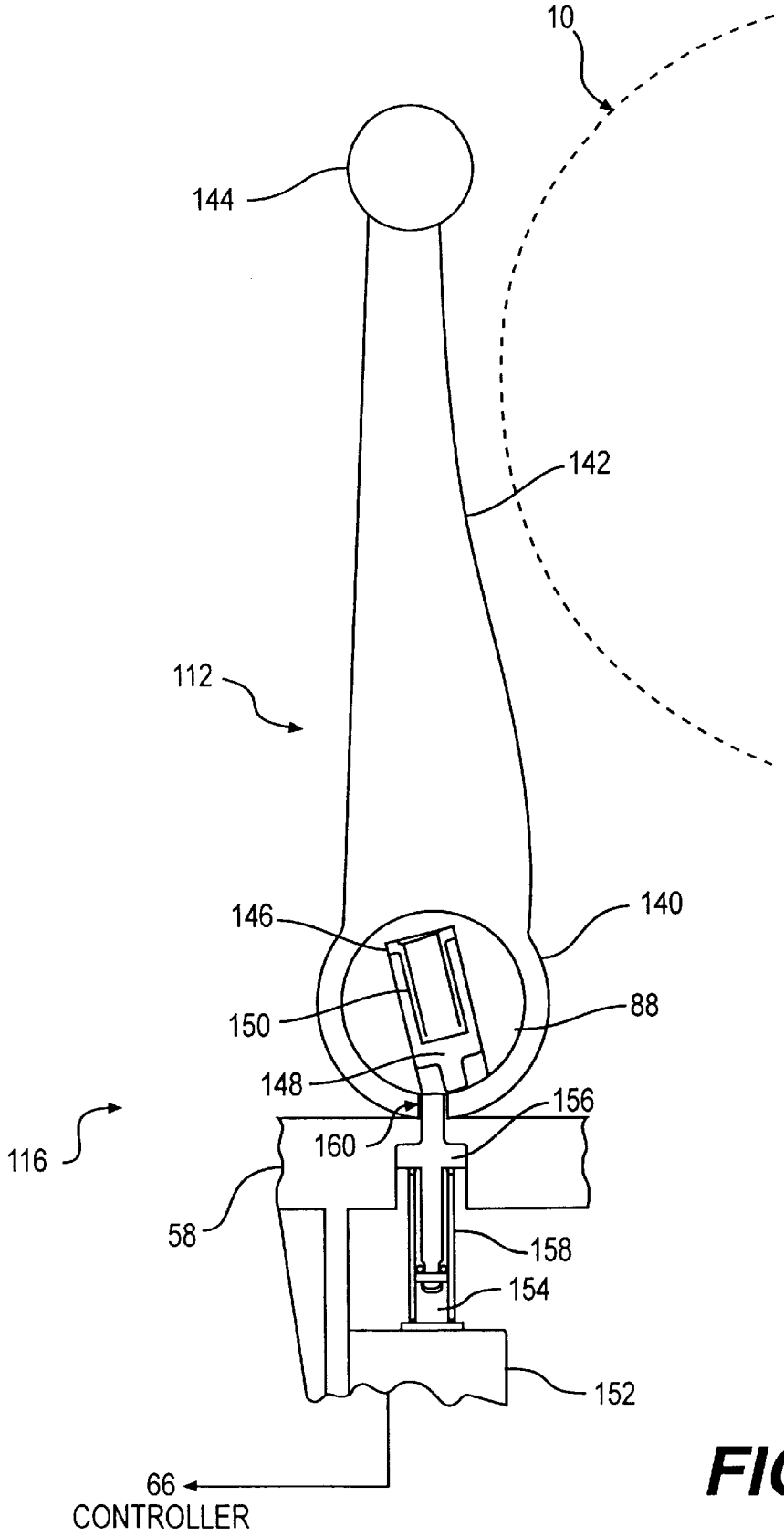
FIG. 9 is a schematic axial detail view of the gate mechanism shown in FIG. 6.

FIG. 9 schematically depicts a representative selector gate coupling mechanism from the preferred embodiment. As with the fork elements, gate 112 has a sleeve-type proximal end 140 affording a sliding fit over gate crankshaft 88, with distal portion 142 contoured to engage a propellant charge or projectile (a schematic of MACS module 10 shown dotted), and preferably including roller 144. Gate crankshaft 88 includes blind recess 146, key 148, and biasing spring 150, while propellant magazine frame 58 mounts linear actuator 152 with armature 154 connected to decoupling plunger 156 which is biased (upward) by spring 158. One skilled in the art would readily understand that in the default position with no power to actuator 152, spring 158 would override key spring 150 and plunger 156 would engage slot-aperture 160, preventing dependent rotary motion of gate 112 with oscillating gate crankshaft 88 as depicted in FIG. 9. Upon activation by signal from controller 66, actuator 152 would cause plunger 156 to withdraw from slot-aperture 160 allowing key 148 to engage slot 160 and couple gate 112 to gate crankshaft 88 for dependent oscillatory rotation.

Because each transfer fork and each selector gate has a linear actuator, spring-loaded decoupling plunger and spring-loaded key, it is possible to individually select one or more propellant charges to be either inserted or removed from any position in magazine carrier 60 depicted in FIG. 2; or to select a projectile to be either inserted or removed from the (undivided) carrier in projectile magazine 52.

In operation, by circulating the carriers through the serpentine magazine path until the proper carrier arrives at the respective turn-around position 64 or 64' during upload, the proper (empty) carrier is presented to the transfer apparatus. Only selected transfer forks 92, and gates 112 or 112' move with the respective carrier in proper timing such that the munition is laterally transferred from axial conveyor 56 into that carrier. During download, the carrier with the desired munition is presented to the transfer apparatus. Again, only selected ones of transfer forks 92 and gates 112 or 112' move with the carrier in proper timing such that the munition is laterally transferred from the carrier onto axial conveyor 56.

To control the lateral transfer of propellant charges such as, for example, MACS modules 10 between axial conveyor 56 and the magazine 54 the transfer mechanism includes a transfer fork 92 and selector gate 112 for each MACS space in the MACS carrier. All forks (and gates) would act in unison when transferring a full compliment of MACS and only the number of forks (and gates) necessary would act to transfer a partial load of MACS. Transfer apparatus 50 uses "permanent" drive trains and mechanical connections provided by the drive cams and linkages to coordinate the movement of the respective transfer crankshafts and gate crankshafts of each magazine.

Figure 4:
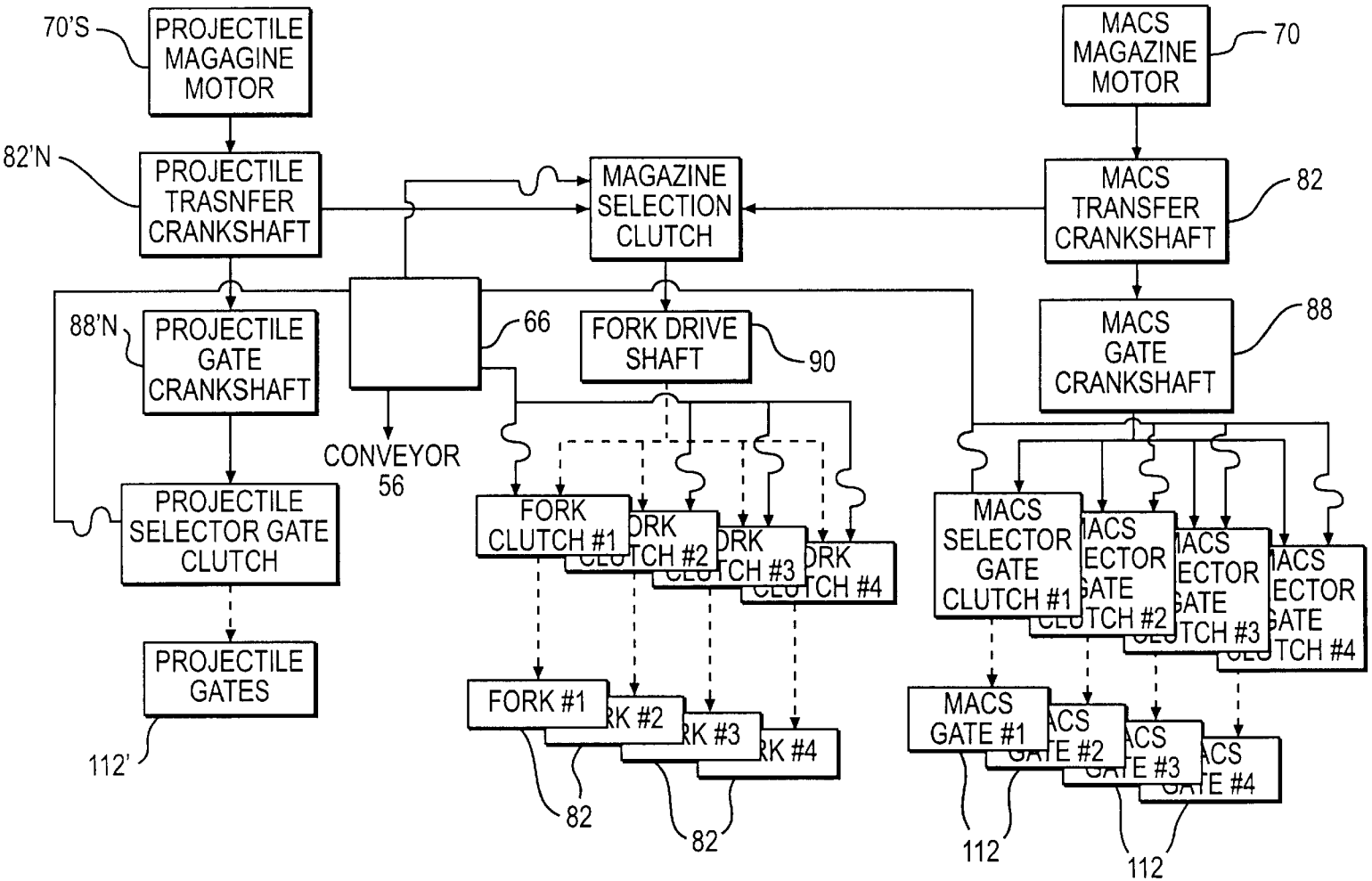
FIG. 4 is a schematic of the process by which the transfer apparatus of the present invention operates to selectively transfer items.

The proper timing of the forks and gates to the magazines is accomplished by the combination of permanent mechanical couplings provided by the preset gear trains and the conditional mechanical couplings or "selection clutches", dictated by controller 66 as depicted in FIG. 4. The drive motors 70' and 70 for the projectile and MACS magazines 52 and 54, respectively, are independent of each other. For example, as the MACS magazine drive motor 70 moves the MACS carriers 60 it also rotates MACS transfer cam 78. MACS transfer cam 78 causes the MACS transfer crankshaft 82 to cycle through an angular sector. Since MACS gate cam 84 is rigidly attached to transfer crankshaft 82, it also cycles through the angular sector. The MACS gate cam motion causes MACS bell crank 86 to rotate back and forth imparting oscillatory rotational motion to MACS gate crankshaft 88. In a similar fashion, driving the carriers in projectile magazine 52 causes motion in the respective transfer apparatus components associated with the projectile magazine.

A transfer is accomplished by the controller 66 providing:

1. A control signal to actuator 100 of transfer shaft coupling mechanism 118, to select which magazine munitions are to be transferred into (or out of). This signal causes the coupling of the selected transfer crankshaft (82 or 82') to the fork drive shaft 90.

2. Control signals to selected ones of actuators 128 of transfer element coupling mechanism 114 to couple the selected fork(s) 92 to drive shaft 90.

3. Control signals to selected actuators 152 or 152' of the respective gate element coupling mechanisms (116 or 116') to couple the selected gate(s) to the respective gate crankshaft (88 or 88').

Then as the carrier comes into position the selected gate(s) and transfer fork(s) will cause the lateral transfer of munitions in the manner described in prior U.S. Pat. No. 5,212,338. As stated previously and would be understood by one skilled in the art, controller 66 also can be used to control conveyor 56 such as through position feedback control to provide increased coordination to the overall transfer process.

It will be apparent to those skilled in the art that various modifications and variations can be made to the apparatus of the present invention without departing from the spirit of the invention. For example, one or more wedge-shaped camming elements could be mounted on the magazine frame or housings to assist MAC module transfer to the bucket carriers 60 for instances of slight axial misalignment between the MAC's on axial conveyor 56 and the storage positions in the bucket carrier 60. Alternatively, the camming elements could be affixed to the leading edges of the spacer elements 44 in the bucket carriers 60. Thus, it is intended that the present invention be construed to cover modifications and variations thereof, provided they come within the spirit and scope of the appended claims and their equivalents.

What is claimed is:

1. Apparatus for selectively transferring storable items between a storage space and a location outside the storage space, the transfer mechanism comprising:

(i) a rotatable drive shaft positioned proximate the storage space and the outside location, (ii) at least one transfer element operatively associated with said drive shaft and having a distal portion configured for engaging an item and a proximal end, and (iii) a transfer element coupling mechanism for selectively coupling said transfer element proximal end to said drive shaft for dependent rotation therewith, said distal portion rotatively movable between a position in the storage space and the outside location only when said proximal end is coupled to said drive shaft.

2. The apparatus as in claim 1, wherein the apparatus includes a plurality of said transfer elements each independently selectively coupleable to said drive shaft by a respective transfer element coupling mechanism.

3. The apparatus of claim 1, wherein said transfer element coupling mechanism also restrains said transfer element from rotary motion when said transfer element proximal end is uncoupled from said drive shaft and said transfer element distal portion is at said outside location position.

4. The apparatus as in claim 1, wherein said transfer element proximal end includes a sleeve member slidably surrounding said drive shaft, and wherein the transfer element coupling mechanism includes a keying member for selectively interconnecting the sleeve member and the drive shaft for dependent rotation.

5. The apparatus as in claim 4, wherein the sleeve member includes an aperture; wherein said keying member is disposed in said drive shaft and is movable between a coupled position engaging said aperture and an uncoupled position not engaging said aperture; and wherein the transfer element coupling mechanism further includes an actuator assembly disposed for controlling the position of the keying member.

6. The apparatus as in claim 5, wherein said keying member is biased toward the keying member coupled position by biasing means.

7. The apparatus as in claim 5, wherein said actuator assembly includes a plunger having an activated position and a deactivated position, said actuator assembly being disposed to block said aperture with said plunger when said plunger is in the deactivated position.

8. The apparatus as in claim 7, wherein said actuator assembly includes a solenoid operatively connected to said plunger.

9. The apparatus as in claim 7, wherein said actuator assembly is fixed relative to rotary motion of said rotatable shaft and said transfer element, and wherein when said plunger is in the deactivated position, said plunger engages said aperture and restrains said transfer element from rotary motion.

10. The apparatus as in claim 1, further including a controller operatively connected to said transfer element coupling mechanism.

11. The apparatus as in claim 1, further including a gating mechanism for selectively permitting or blocking items from being transferred between the storage space and the outside location, said gating mechanism including:

(i) a rotatable gating shaft positioned adjacent the storage space, and the outside location, (ii) at least one gate element operatively associated with said gating shaft and having a proximal end and a distal portion, said gate element also being disposed to cooperate with said transfer element, and (iii) a gate element coupling mechanism coordinated with said transfer element coupling mechanism for selectively coupling said gate element proximal end with said gating shaft for dependent rotation therewith, wherein said gate element distal portion is rotatively movable between transfer permitting and transfer blocking positions only when said gate element proximal end is coupled to said gating shaft.

12. The apparatus as in claim 11, wherein said gate element distal portion is configured for supporting an item being transferred when in said transfer permitting position.

13. The apparatus as in claim 11, wherein said gating mechanism includes a plurality of said gate elements each independently selectively coupleable to said gating shaft by a respective gate coupling mechanism.

14. The apparatus as in claim 11, wherein said gate coupling mechanism also restrains said gate element from rotary motion when said gate element proximal end is uncoupled from the gating shaft and said gate element distal portion is in said blocking position.

15. The apparatus as in claim 11, further including a controller operatively connected to said transfer element coupling mechanism and said gate coupling mechanism.

16. The apparatus as in claim 1, further including a driven rotatable transfer shaft associated therewith, positioned adjacent the storage space, and a transfer shaft coupling mechanism for selectively coupling said drive shaft to said transfer shaft for dependent rotation therewith, said transfer shaft coupling mechanism including a drive key carried by said drive shaft for dependent rotation therewith and movable between an engaged position for coupling said transfer shaft and said drive shaft, and a disengaged position where said drive shaft and said transfer shaft are uncoupled, said transfer shaft coupling mechanism further including an actuator operatively connected to said drive key, said actuator being carried by said drive shaft for dependent rotation therewith.

17. The apparatus as in claim 16, wherein said transfer shaft coupling mechanism further includes a cam fixed relative to rotary motion of said drive shaft, wherein said drive key includes a cam follower engaging said cam, and wherein said cam includes cam surfaces restraining said cam follower from rotary motion when said drive key is in said disengaged position.

18. The apparatus as in claim 16, further including a controller operatively connected to said transfer element coupling mechanism and said transfer shaft coupling mechanism.

19. The apparatus as in claim 11, further including a driven rotatable transfer shaft associated therewith, positioned adjacent the storage space, and a transfer shaft coupling mechanism for selectively coupling said drive shaft to said transfer shaft for dependent rotation therewith, said transfer shaft coupling mechanism including a drive key carried by said drive shaft for dependent rotation therewith and movable between an engaged position for coupling said transfer shaft and said drive shaft, and a disengaged position where said drive shaft and said transfer shaft are uncoupled, said transfer shaft coupling mechanism further including an actuator operatively connected to said drive key, said actuator being carried by said drive shaft for dependent rotation therewith, and further including a controller operatively connected to said transfer element coupling mechanism, said transfer shaft coupling mechanism, and said gate coupling mechanism.

20. The apparatus as in claim 19, further including a second gating mechanism for selectively permitting or blocking items from being transferred between a second storage space and the outside location, said second gating mechanism including:

(i) a second rotatable gating shaft positioned adjacent the second storage space, and the outside location, (ii) at least one second gate element operatively associated with said second gating shaft and having a proximal end and a distal portion, said second gate element also being disposed to cooperate with said transfer element, and (iii) a second gate coupling mechanism also coordinated with said transfer element coupling mechanism for selectively coupling said second gate element proximal end with said second gating shaft for dependent rotation therewith, still further including a second driven rotatable transfer shaft positioned adjacent the second storage space, and a second transfer shaft coupling mechanism for selectively coupling said drive shaft to said second transfer shaft for dependent rotation therewith, said second transfer shaft coupling mechanism including a second drive key carried by said drive shaft for dependent rotation therewith and movable between an engaged position for coupling said second transfer shaft and said drive shaft, and a disengaged position where said drive shaft and said second transfer shaft are uncoupled, said actuator also operatively connected to said second drive key wherein said controller also is operatively connected to said second transfer element coupling mechanism and said second transfer shaft coupling mechanism.

21. Method for selectively transferring storable items between a storage space and a location outside the storage space, the transfer mechanism comprising:

(i) providing a rotatable drive shaft positioned proximate the storage space and the outside location, (ii) providing a plurality of transfer elements operatively associated with said drive shaft each having a distal portion configured for engaging an item and a proximal end;

(iii) oscillating the drive shaft;

(iv) selectively coupling the proximal ends of selected ones of the plurality of transfer elements to the oscillating drive shaft for dependent oscillation therewith, said selected transfer elements rotatively moving items between a position in the storage space and the outside location; and (v) restraining transfer elements not selected from oscillating when the drive shaft is oscillating.

* * * * *